US006847035B2

(12) United States Patent
Sharma

(10) Patent No.: US 6,847,035 B2
(45) Date of Patent: Jan. 25, 2005

(54) DEVICES AND METHODS FOR THE DETECTION OF PARTICLES

(75) Inventor: Shiv Sharma, Amersham Buckinghamshire (GB)

(73) Assignee: Amersham Biosciences UK Limited, Amersham (GB)

( * ) Notice: Subject to any disclaimer, the term of this patent is extended or adjusted under 35 U.S.C. 154(b) by 0 days.

(21) Appl. No.: 10/475,289

(22) PCT Filed: Apr. 19, 2002

(86) PCT No.: PCT/GB02/01753

§ 371 (c)(1),
(2), (4) Date: Oct. 17, 2003

(87) PCT Pub. No.: WO02/086945

PCT Pub. Date: Oct. 31, 2002

(65) Prior Publication Data

US 2004/0129875 A1 Jul. 8, 2004

(30) Foreign Application Priority Data

Apr. 23, 2001 (GB) ..... 0109883

(51) Int. Cl.[7] ..... H01J 49/00

(52) U.S. Cl. ..... 250/287; 250/281; 250/282; 250/299

(58) Field of Search ..... 250/287, 281, 250/282, 299

(56) References Cited

U.S. PATENT DOCUMENTS 4,383,171 A * 5/1983 Sinha et al. ..... 250/282
5,998,215 A * 12/1999 Prather et al. ..... 436/173

OTHER PUBLICATIONS

Sinha, M. P. "Laser–Induced Volatilization and Ionization of Microparticles" Review of Scientific Instruments, American Institute of Physics, New York, US vol. 55, No. 6, Jun. 1984 pp. 886–891.

* cited by examiner

*Primary Examiner*—Nikita Wells
*Assistant Examiner*—James J. Leybourne
(74) *Attorney, Agent, or Firm*—Royal N. Ronning, Jr.; Stephen G. Ryan; Yonggang Ji

(57) ABSTRACT

The present invention relates to devices and methods for determining the masses of particles by measuring the time between a first event such as a sample (5) being ionized, (or a beam of electromagnetic radiation being scattered by a particle (15) and electromagnetic radiation scattered by said particle being detected by a detection means,) and a second event in which a beam (21) of electromagnetic radiation is scattered by a particle (15) from said ionized sample and electromagnetic radiation (25) from said beam (21) scattered by said particle (15) is detected by a detection means (11).

6 Claims, 5 Drawing Sheets

DEVICES AND METHODS FOR THE DETECTION OF PARTICLES

FIELD OF THE INVENTION

The present invention relates to detecting devices for detecting single molecules, groups of similar molecules, trains of differing molecules, methods for detecting these using said detecting devices, and the use of such devices and methods to detect such molecules.

PRIOR ART

In prior art devices and methods such as matrix assisted laser ablation time of flight mass spectrometers (MALDI-TOF MS), for measuring the time of flight (TOF) of particles (such as single molecules, groups of similar molecules, trains of different molecules or the like), the particles are ablated from a matrix by a laser pulse and accelerated towards a timing detector by an electric field at one end of a vacuum flight tube. The timing detector is usually a micro channel plate detector, which is an electron multiplier and needs a certain number of particles to hit it before a count is registered The timing detector measures the time from the laser pulse to a number of particles (having substantially the same mass/charge ratio and sufficient in number to be registered) hitting the timing detector. A problem with these devices is that the limitations in sensitivity of the micro-channel plate detectors means that they are not suitable for detecting single particles. Another difficulty is that larger mass particles, which are often important in biological measurements, produce lower signals at the detector and hence TOF MS is not suitable for their detection.

SUMMARY OF THE INVENTION

According to the present invention, at least some of the problems with the prior art are solved by means of devices having the features present in the characterising portions of claim 1 and claim 2, and by methods having the features mentioned in the characterising portion of claim 4. In particular, the devices of claims 1 and 2 can detect photons of light or other electromagnetic radiation scattered by a single particle or by a train of particles or groups of particles. Furthermore the present invention gives a high sensitivity for larger mass particles, which, due to their high mass but relatively slow velocity, are difficult to detect in prior art mass spectrometers but which, due to their large size, scatter many photons and are therefore relatively easy to detect using the present invention.

DETAILED DESCRIPTION OF EMBODIMENTS ILLUSTRATING THE INVENTION

Figure 1A:
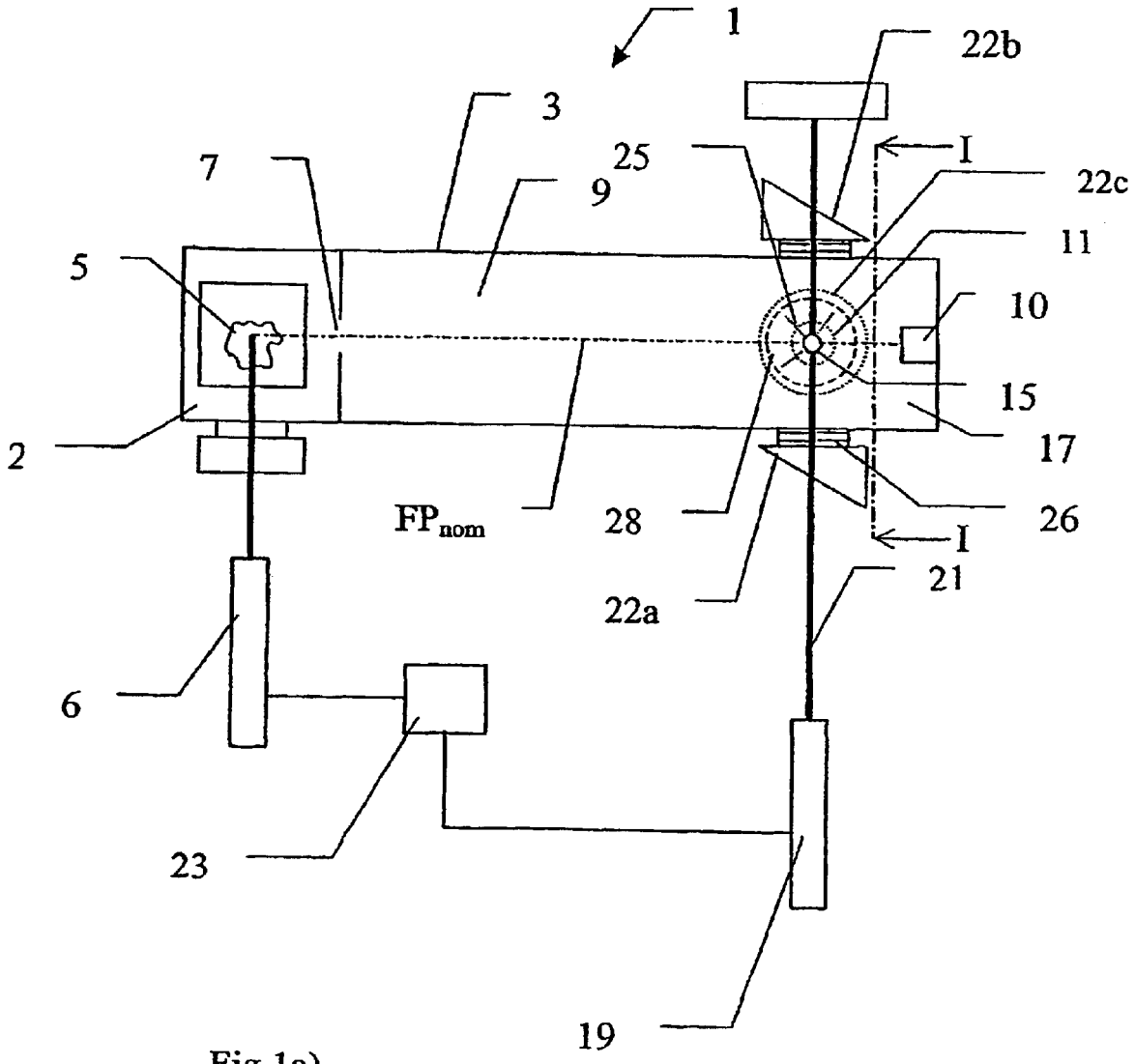
FIG. 1*a*) shows schematically a lateral view of a first embodiment of a device in accordance with the present invention.
Figure 1B:
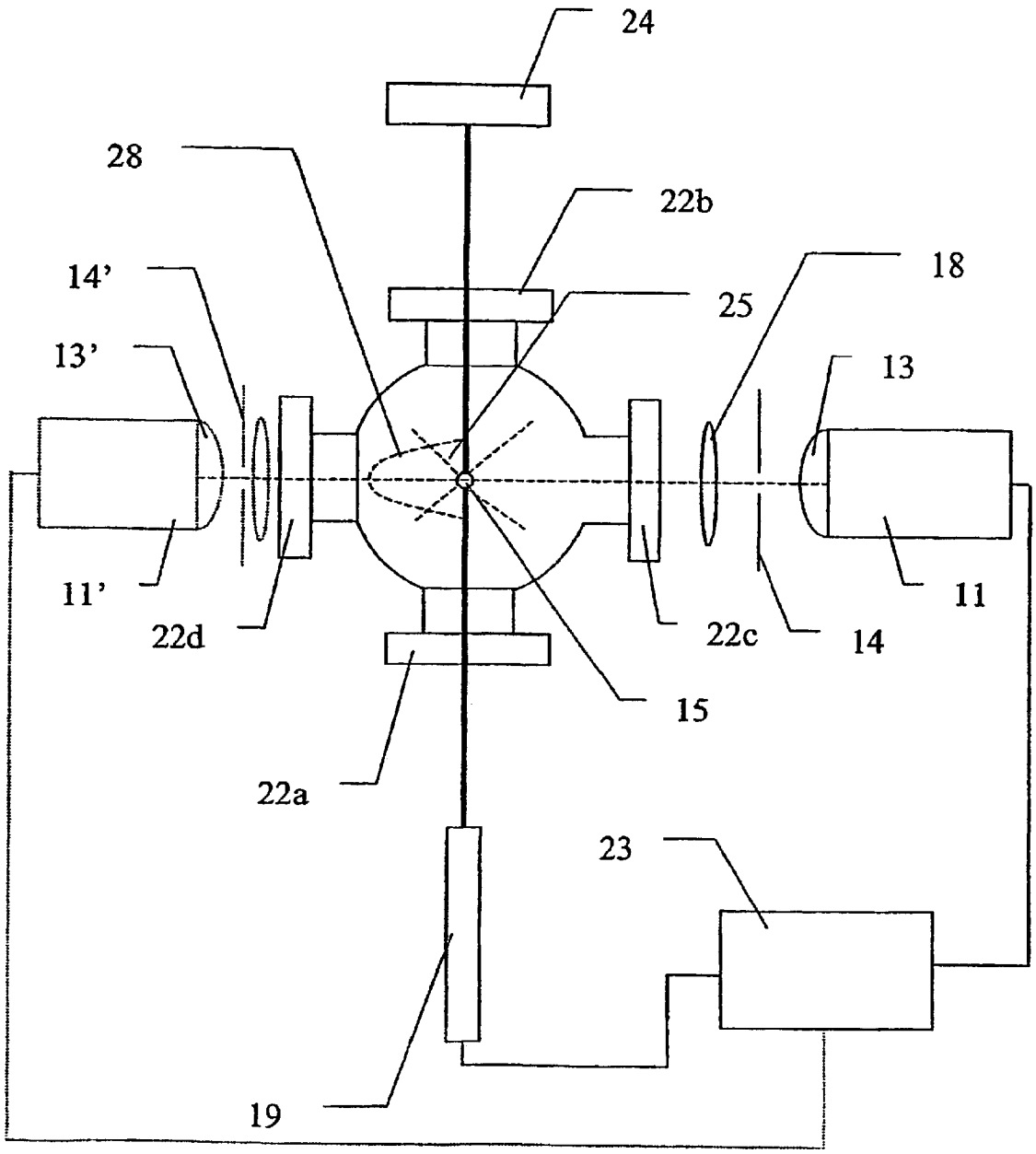
FIG. 1*b*) shows schematically an enlarged section through line I—I of the device of FIG. 1*a*)

FIGS. 1*a* and 1*b* show schematically, and not to scale, a first embodiment of a mass spectrometer 1 in accordance with the present invention. Well-known features of the mass spectrometer 1 that are not relevant to the present invention have been omitted for the sake of clarity. Mass spectrometer 1 (e.g. Ettan Mass Spectrometer from Amersham Biosciences, Sweden) has at its proximal end 2 a sample chamber 3 in which a sample 5 to be analysed can be ionised, by ionising means such as a laser 6. The sample may be any substance of interest, for example a biological sample in the form of a piece of tissue or a sample of fluid or a smear or blot or the like, or a sample comprising one or more chemical compounds that need to be identified or a substance, the composition of which is being investigated, etc. Sample chamber 3 has an orifice 7 which leads into an elongated flight chamber 9. When the mass spectrometer 1 is being used, air may be evacuated from flight chamber 9 so that it contains a near vacuum. Optionally, the distal end 17 of flight chamber 9 may be provided with collecting means 10 for collecting ions so that the components of the sample 5 may be collected for further analysis.

As can be seen in FIG. 1*b*, flight chamber 9 is provided with an electromagnetic radiation detection means such as a photomultiplier tube 11, e.g. of a photon counting type (e.g. a Hamamatsu R7400P from Japan), or a photon counting module (e.g. a Perkin Elmer SPCM-AQR-12-FC, USA), which is capable of generating an output signal from a single photon detected (taking the quantum efficiency of the detector into account), arranged so that its inlet lens 13 is substantially perpendicular to and facing towards the nominal flight path $FP_{nom}$ which the ionised particles 15 of the sample 5 take when flying through the flight chamber 9. Photomultiplier tube 11 is arranged near the distal end 17 of the flight chamber.

A source of electromagnetic radiation, e.g. light, detectable by photomultiplier tube 11, for example a laser 19 (e.g. a Coherent Inc., USA, INNOVA Argon Laser), is arranged to shine a beam 21 of radiation through a window 22*a* in the flight chamber 9 onto the nominal flight path $FP_{nom}$ in front of the photomultiplier input lens 13 but in such a way that the beam 21 does not shine directly into the input lens 13. The opposite side of the flight chamber to window 22*a* is provided with a window 22*b* that leads to a light dump 24 that absorbs the beam 21 and prevents any light from the beam 21 being reflected back into the flight chamber 9. In order to reduce the amount of unwanted light scattered from the beam 21 during its passage from laser to light dump 24, the windows 22*a*, 22*b* are preferably made as Brewster windows (from CVI Laser Corp, USA), i.e. they are angled at the Brewster angle to reduce reflection losses (and hence light scattered by reflection) to a minimum, and black light baffles 26 with small holes aligned with the laser beam 21 are arranged between the windows and the sample 15 to further reduce the amount of unwanted light entering the flight chamber 9. As can be seen in FIG. 1*b*, the photomultiplier tube 11 is preferably arranged with its input lens 13 orthogonal to the path of beam 21. Optionally, a pinhole aperture 14 and/or collecting lens 18 (50 mm diameter, f=100 mm 14 KLA 001/078 collecting lens from Melles Griot, USA) may be arranged in front of the photomultiplier tube 11 such that the detectable volume where the nominal flight path $FP_{nom}$ and the beam 21 coincide is imaged on the pinhole 14, hence providing what is commonly known as a confocal arrangement This confocal arrangement has the advantage of preventing stray photons that do not originate from the detectable volume from reaching the detector 11. As flight chamber 9 is under vacuum then, in the absence of any material passing through the beam 21, no photons from the beam 21 will be scattered into input lens 13 and photomultiplier tube 11 will not register the presence of light. However, when a particle 15 passes through the beam 21 then some photons 25 from the beam 21 will be scattered (shown schematically by dotted lines) and, statistically, it is probable that some of those will enter input lens 13 and be detected by photomultiplier tube 11. Ionising means 6, source of electromagnetic radiation 19 and photomultiplier tube 11 are connected to control and data recording and processing means, such as a microprocessor or computer 23. Control and data recording and processing means 23 controls the operation of the ionising means 6 and contains time measuring means for recording the flight time ΔT from a sample S being ionised to photons being detected by photomultiplier tube 11. The flight time ΔT for a particle that is scattering the light from the source of electromagnetic radiation 11 is proportional to the mass of the particle 15, thus once ΔT is known it is possible to determine the mass of the particle 15 that caused the scattering. A second scattered light detecting arrangement comprising photomultiplier tube 11' and optics 13', 14' may optionally be arranged by a window 22*d* in order to detect light scattered from particle 15. The output from this arrangement could be processed along with the output from the first scattered light detection arrangement using PMT 11 to give a more accurate system.

Alternatively, a parabolic mirror 28 (shown by dashed lines in FIGS. 1*a*, 1*b*) may optionally be arranged inside the flight chamber 9 opposite PMT 11 such that any light entering it is reflected onto the input lens 13 of PMT. 11. In this way almost half of the light scattered by particle 15 could be transmitted to PMT 11.

In order to achieve the highest possible sensitivities, it is possible to cool the photomultiplier tube in order to reduce its background noise, referred to as background counts.

Figure 2A:
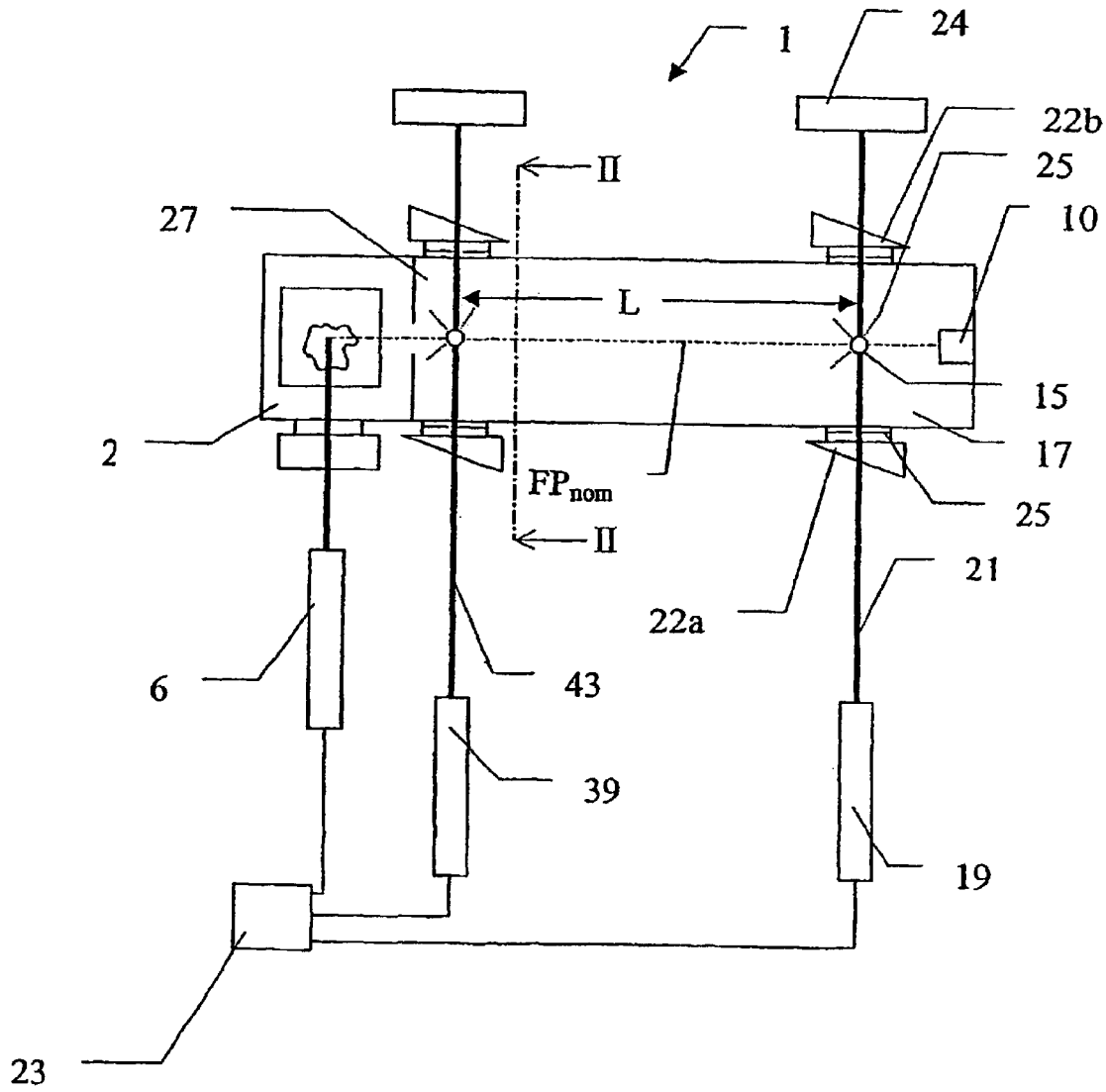
FIG. 2*a*) shows a schematically a second embodiment of a device in accordance with the present invention.
Figure 2B:
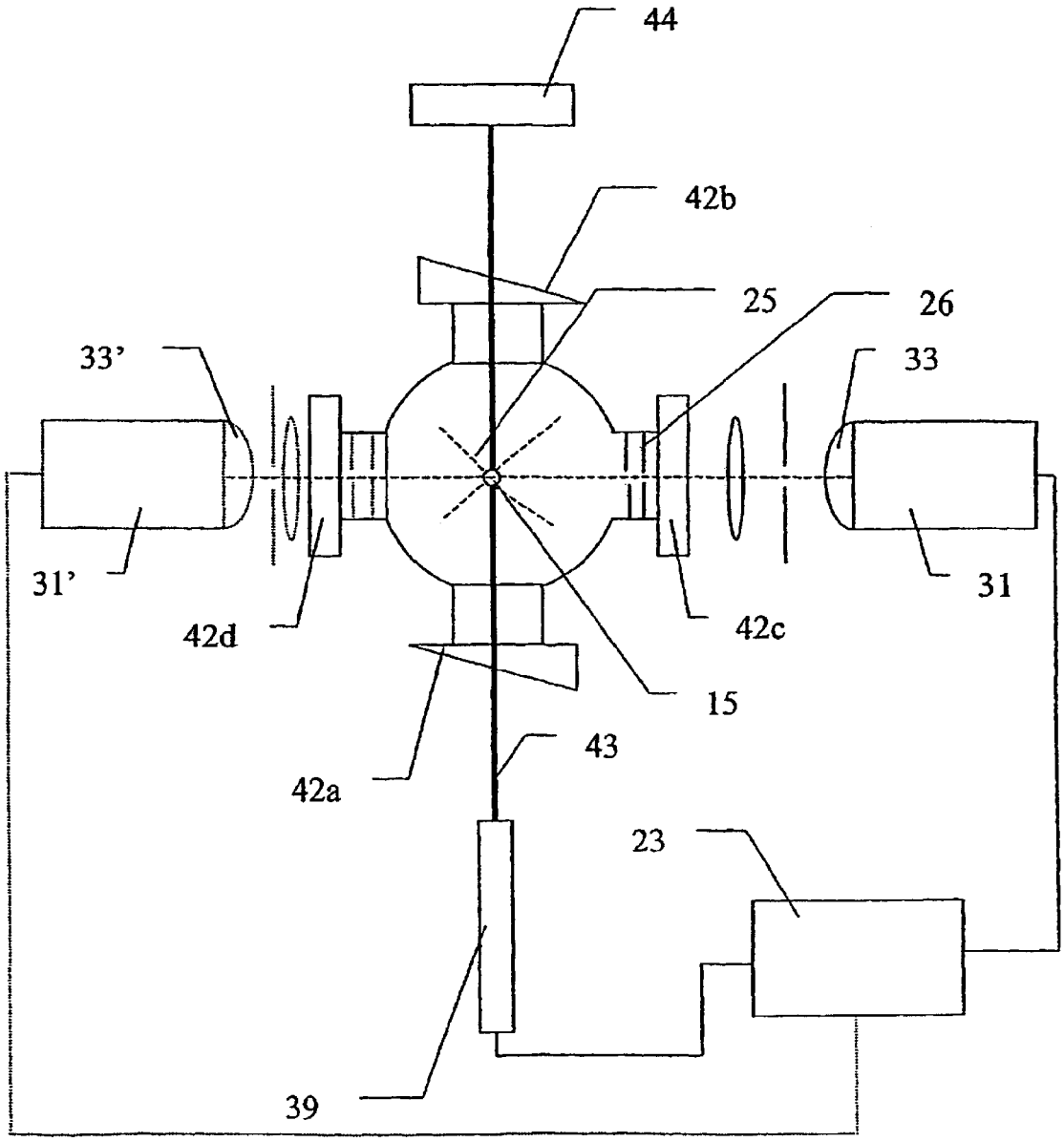
FIG. 2*b*) shows schematically an enlarged section through line II—II of the device of FIG. 2*a*); and, FIG. 3 shows a third embodiment of a device in accordance with the present invention.

A second embodiment of the present invention is shown schematically, and not to scale, in FIGS. 2*a* and 2*b* and the same reference numbers as used for the features of the embodiment shown in FIGS. 1*a* and 1*b* are used for similar features in this embodiment. In addition to a first electromagnetic radiation detection means such as photomultiplier tube 11 provided at the distal end of flight chamber 9, another similar photon detection means such as photomultiplier tube 31 is arranged at the proximal end 27 of the flight chamber 9. Another source of electromagnetic radiation, e.g. light, detectable by photomultiplier tube 31, for example a laser 39, is arranged to shine a further beam 43 of radiation through window 42*a* in the flight chamber 9 onto the nominal flight path $FP_{nom}$ at a known distance L from the position where the first beam 21 intersects the nominal flight path $FP_{nom}$ in front of the photomultiplier input lens 33 of the additional photomultiplier tube 31 so that it does not shine directly into the input lens 33. Additional photomultiplier tube 31 and laser 39 are connected to control means 23. In this embodiment, the photomultiplier tube 31 arranged at the proximal end of the flight chamber 9 is used to detect a particle when light from beam 43 is scattered by a particle is at the proximal end 27 of the flight tube 9. The same particle is then detected a short time ΔT later by light that it scatters from beam 21 being detected at the photomultiplier tube 11 at the distal end 17 of the flight chamber 9. As the distance L between the photomultiplier tubes 11,31 is known it is possible to calculate the speed of the particle and subsequently its mass (or mass/charge ratio). This calculation can be performed by control means 23 which may comprise a program for analysing the signals corresponding to particles detected by the photomultiplier tubes 11, 31. This program could correlate the signals from the photomultiplier tubes so that the signals from each particle or group of particles detected by the photomultiplier tube at the proximal end of the flight chamber 9 can be compared against the corresponding signal detected at the photomultiplier tube at the distal end of the flight chamber 9. The time between the corresponding signal being registered can them be used to determine the mass of the particle or group of particles which produced the signals.

Figure 3:
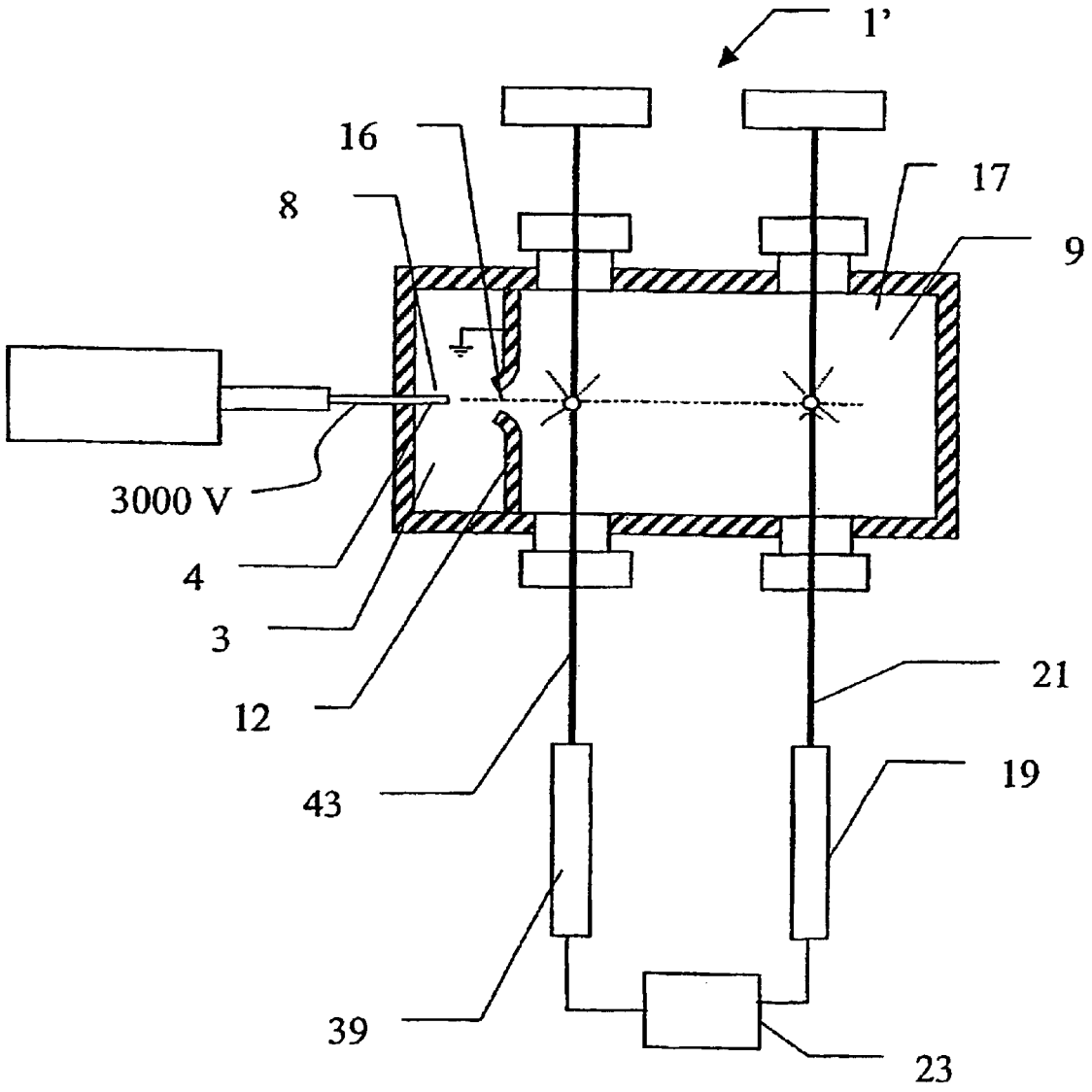

FIG. 3 shows schematically, and not to scale, a third embodiment of the present invention and the same reference numbers as used for the features of the embodiments shown in FIGS. 2*a*–2*b* are used for similar features in this embodiment. In this embodiment the source of particles is a liquid chromatograph 1' with a discharge tube 4 leading into the sample chamber 3. This discharge tube 4 is typically in the form of a capillary tube 4 which has an spray tip 8 which projects into the sample chamber 13 of the device 1. The capillary tube 4 is connected to an electrical potential of, for example, 3000 Volts. The sample chamber 3 is separated from the flight chamber 9 by an inlet plate 12 containing an inlet orifice 16 at a lower potential than the capillary tube, for example, earth potential. Electrically charged liquid drops leave the spray tip 8 of capillary tube 4 and evaporate as they travel towards the inlet orifice 14. This leads to ionisation of the sample molecules in the liquid and these molecules are projected to the distal end 17 of the flight chamber 9. These molecules cause scattering of the beams 21,43 as described above and thus the mass of these molecules can be also detected by measuring the time between the signals that they produce in the photomultiplier tubes, as also described above.

In order to ensure that the photomultiplier tubes identify the same particle, it is preferable that the intensities of the radiation beams where they intersect the nominal flight path $FP_{nom}$ are substantially identical and that the photomultiplier tubes 11, 31 have substantially the same specification. This can be achieved by using two sources 19, 39 adjusted to produce the same power and focused to the same spot size on the nominal flight path $FP_{nom}$ or by providing one source which has its beam split into two paths, one at the distal end of the flight tube and one at the proximal end, each focused to the same spot size onto the nominal flight path $FP_{nom}$. It is also possible to have the laser source 19 routed past the detection point 13 to the other detection point 33 with the use of mirrors, optical fibres, prisms or the like. If the beams have substantially identical intensities then the number of photons scattered by a particle will be substantially the same at the proximal and distal ends of the flight chamber. It will therefore be possible to recognise a particle that has passed the proximal photomultiplier tube 31 when it passes the distal photomultiplier tube 31 as the number of photons detected by the two photomultiplier tubes 11, 31 will be substantially the same.

It is also conceivable to use a single detector and to route the scattered light from a number of scatter points along the nominal flight path of the molecule(s), by means of lenses, fibre optics, mirrors, etc. to the single detector.

Note that the number of particles scattered by a particle is given by:

$$Nsca = 1.3 * 10^4 * \frac{1}{\lambda^4} * \left(\frac{n^2 - 1}{n^2 + 2} * a^2\right)^2 \frac{Nt}{Pl^2}$$

where

λ=wave length, n=refracted index of the particle a=particle radius

N=number of photons per second per unit watt t=time and $I^2$=the diameter/width of the laser focus cross section.

Thus the number of photons scattered by a particle is dependent, amongst others, on the fourth power of the radius of the particle. If λ=500 nm, n=1.6, N=2.5 E+18, t=1.0 E−8 and 1=1.0 E+8 nm, then a particle or molecule with a diameter of 20 nm would scatter about 18000 photons in 1 ns using a 1 W laser. A particle with a diameter of 30 nm would scatter about 460000 photons with a 1 W laser. Typically a photo multiplier works at a 5–10% efficiency i.e. it only registers a hit when being struck by 10–20 photons and in order to avoid registering artefacts as molecules or particles a threshold could be set such that a hit is only registered if, say 3 or 5 photons are detected in 1 ns. This means that using only a 1 W laser it is possible to reliably detect the light scattered by a 20 nm diameter particle. Smaller particles are reliably detectable by using a more powerful laser. This can be achieved by pulsing the laser so that it fires short duration pulses that have much higher energy levels, e.g. of the order of kW, and which are timed to intersect the nominal flight path when particles are expected to be passing though the detection point(s). It could also be achieved by constructing the device so that the nominal flight path passes through the laser cavity of a laser where the laser intensity is at its most intense.

In order to prevent the particles, etc being deflected by the beam(s) of electromagnetic radiation, it is conceivable to provide two counter-propagating beams of substantially equal strength that are focused on the same volume on the nominal flight path, i.e. to provide two beams that are arranged with a 180° angle between their axes so that their effects on the particles cancel out It is also conceivable to use a plurality of detecting devices to detect the scattered radiation from each beam in order to increase the number of signals received for each particle or the like. This would give a plurality of signals for each detected particle or the like and would make the correlation between the signals detected at different positions on the nominal flight path more accurate.

The above mentioned embodiments are intended to illustrate the present invention and are not intended to limit the scope of protection claimed by the following claims.

What is claimed is:

1. A device for determining the mass of a particle, groups of similar mass particles or the like ionized from a sample, comprising means for ionizing a sample or portion of a sample and a flight chamber (9);

a source (19) of electromagnetic radiation having a first beam (21) directed onto the nominal flight path $FP_{nom}$ that the particle (15) is intended to take through said flight chamber (9);

first electromagnetic radiation detection means (11) arranged to detect scattered electromagnetic radiation from said first beam (21);

control means (23) for determining the time between a) said sample or portion of a sample being ionized and b) electromagnetic radiation (25) scattered by the particle, groups of similar mass particles or the like ionized from said sample or portion of a sample being detected by first electromagnetic radiation detection means (11).

2. A device for determining the mass of a particle, groups of similar mass particles or the like ionized from a sample, comprising means for ionizing a sample or portion of a sample and a flight chamber (9);

a source (19) of electromagnetic radiation having a first beam (21) directed onto the nominal flight path $FP_{nom}$ that the particle (15) is intended to take through said flight chamber (9);

first electromagnetic radiation detection means (11) arranged to detect scattered electromagnetic radiation from said first beam (21);

at least one additional beam (43) of electromagnetic radiation directed onto said nominal flight path $FP_{nom}$ at a distance L from said first beam (21);

second electromagnetic radiation detection means (31) arranged to detect scattered electromagnetic radiation from said at least one additional beam (43);

control means (23) for determining the time between a) electromagnetic radiation from said first beam (21) scattered by ionized particles, groups of similar mass particles or the like ionized from said sample or portion of a sample being detected by said first electromagnetic radiation detection means (11) and b) electromagnetic radiation from said at least one additional (43) beam scattered by said ionized particles, groups of similar mass particles or the like ionized from said sample or portion of a sample being detected by said second electromagnetic radiation detecting means (31).

3. The device of claim 2 further comprising means for correlating signals from said electromagnetic radiation detecting means (11), (31) in order to determine which of said particles, groups of similar mass particles or the like produced said signals.

4. A method for determining mass of a particle, groups of similar mass particles or the like ionized from a sample, comprising determining the time lapsed between at least one event and the subsequent detection of electromagnetic radiation scattered by said particle, group of particles or the like, and using the time lapse to calculate the mass of said particle or group of particles.

5. The method of claim 4 wherein at least one of said at least one events, is the ionization of a sample from which said particle, group of particles or the like originates.

6. The method of claim 4 wherein at least one of said at least one events, is the detection of electromagnetic radiation scattered by said particle, group of particles or the like.

* * * * *